United States Patent [19]

Ballard et al.

[11] Patent Number: 4,891,004

[45] Date of Patent: Jan. 2, 1990

[54] CONTROL OF ENERGY USE IN A FURNACE

[75] Inventors: Gary W. Ballard, Indianapolis; Daniel J. Dempsey, Carmel, both of Ind.

[73] Assignee: Carrier Corporation, Syracuse, N.Y.

[21] Appl. No.: 164,936

[22] Filed: Mar. 7, 1988

Related U.S. Application Data

[63] Continuation-in-part of Ser. No. 67,501, Jun. 29, 1987, Pat. No. 4,815,524.

[51] Int. Cl.[4] ..... F23N 5/00; F24H 3/00

[52] U.S. Cl. ..... 431/6; 126/116 A; 431/14; 431/20; 431/29; 236/11; 236/94

[58] Field of Search ..... 431/29, 14, 30, 31, 431/6, 24, 20; 236/11, 94; 307/39; 126/116 A

[56] References Cited

U.S. PATENT DOCUMENTS

| | | | |
|---|---|---|---|
| 2,768,676 | 10/1956 | Deubel | 431/31 X |
| 3,126,154 | 3/1964 | Shoalts | 236/11 X |
| 3,549,088 | 12/1970 | Obenhaus et al. | 431/31 X |
| 4,087,046 | 5/1978 | Borucki et al. | 236/11 |
| 4,175,699 | 11/1979 | Engeling et al. | 126/116 A |
| 4,263,886 | 4/1981 | Batchelor | 126/116 A |
| 4,303,383 | 12/1981 | Black et al. | 431/31 |
| 4,348,169 | 9/1982 | Swithenbank et al. | 431/24 X |
| 4,384,844 | 5/1983 | Yamamoto et al. | 431/26 X |

*Primary Examiner*—Carl D. Price

*Attorney, Agent, or Firm*—Dana F. Bigelow

[57] ABSTRACT

A microprocessor control determines, in the course of initiating a heating cycle, whether the blower is operating in the continuous mode, and if it is, the control prompts the blower to be turned off prior to the ignitor being turned on. In this way, the blower and ignitor are never on at the same time and the instantaneous total current draw is limited to thereby reduce the occurrence of burned out fuses or circuit breaker trips.

11 Claims, 3 Drawing Sheets

CONTROL OF ENERGY USE IN A FURNACE

This application is a continuation-in-part of application Ser. No. 67,501 now U.S. Pat. No. 4,815,524 filed June 29, 1987.

BACKGROUND OF THE INVENTION

This invention relates generally to residential furnaces, and more particularly, to the control of energy use in a furnace having both an electronic ignitor and a blower which is adapted for continuous use.

Residential furnaces operate in response to thermostat settings to cyclically operate through the heating cycle each time the sensed temperature in the space reaches a predetermined lower level and to shut off when the sensed temperature reaches a predetermined higher level. Initiation of the combustion process at the start of each heating cycle has traditionally been accomplished by way of a constantly burning pilot light. However, in the interest of economy, it has become common practice to replace the pilot light with an electronic ignition system commonly referred to as a hot surface ignitor. Such a device is prompted by a control system to turn on when ignition is desired and to turn off when a flame has been detected. It is therefore off most of the time but, since it operates on the basis of electrical resistance, it draws a substantial amount of current (i.e. 4 to 5 amps) when it is on.

In a conventional heating cycle of a residential gas furnace, when a call for heat is made by the thermostat, the inducer is first turned on by the control to purge the system of unwanted gases. The ignitor is then turned on and allowed to heat up for a short period of time and then the fuel supply is turned on. When ignition occurs and is then detected by a flame sensor, the ignitor is turned off and, after a s.ituable delay for heating up the heat exchangers, the circulating air blower is turned on to move the heated air out to the duct to be circulated throughout the house. It will thus be recognized that, during this normal mode of operation, the blower is always off when the ignitor is turned on and does not come on until the ignitor is turned off.

It has now become desirable at times to operate the circulating blower on a continuous basis, irrespective of whether the burner is turned on or not. One reason for this trend is that, because of fuel economy, houses are built much tighter and the natural air circulation is therefore reduced. Another reason is to make better use of the electrostatic air cleaners which are becoming common in use to improve indoor air quality.

The motor that is used to drive the circulating air blower in a forced air furnace is of a substantial size (e.g 115 volt, ¾ Horsepower) and can therefore draw a substantial amount of current during operation. For example, in a furnace which does not have an air conditioning system incorporated therein, and therefore does not have a coil to reduce the air flow rate, the circulating air blower motor may draw as much as 12 amps during steady state continuous operation. Thus, if the ignitor is turned on for a heating cycle when the circulating air blower is operating on a continuous basis, the total current draw to the furnace will be greater than 15 amps and will therefore cause a 15 amp fuse to burn out or a circuit breaker to trip. This, in turn, will require at least a change in the fuse, which is inconvenient, and may be cause for other inconvenience and expense to an operator that may not be aware of the cause of the problem.

It is therefore an object of the present invention to provide an improved control system for a residential furnace having an electronic ignition system.

Yet another object of the present invention is the provision in a forced air furnace for continuous operation of the blower without inconvenience to the operator.

Still another object of the present invention is the provision in a residential furnace having an electronic ignitor, for the use of the circulating blower in a continuous mode of operation.

Yet another object of the present invention is the provision for a residential furnace ignition control system which is economical to manufacture and effective in use.

These objects and other features and advantages become readily apparent upon reference to the following description when taken in in conjunction with the appended drawings.

SUMMARY OF THE INVENTION

Briefly, in accordance with one aspect of the invention, a furnace control system functions to ensure that the circulating air blower is turned off prior to the electronic ignitor being turned on, thus limiting the total current draw to the furnace and preventing the burning out of a fuse or the tripping of a circuit breaker.

By another aspect of the invention, the control system of a furnace operates during a normal heating cycle to sense when the circulating air blower is operating in the continuous mode. If it is so operating, the control will act to turn the blower off prior to its turning on the electronic ignitor. In this way, the blower and ignitor are never on at the same time, and the allowed current limit draw will not be exceeded to burn out the fuse or trip the circuit breaker.

By yet another aspect of the invention, the control system functions to sense when a flame exists and then responsively turns off the ignitor and eventually turns on the blower. At the end of the heating cycle, the inducer and gas valve are turned off and the blower is allowed to continue to operate in the continuous mode of operation.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
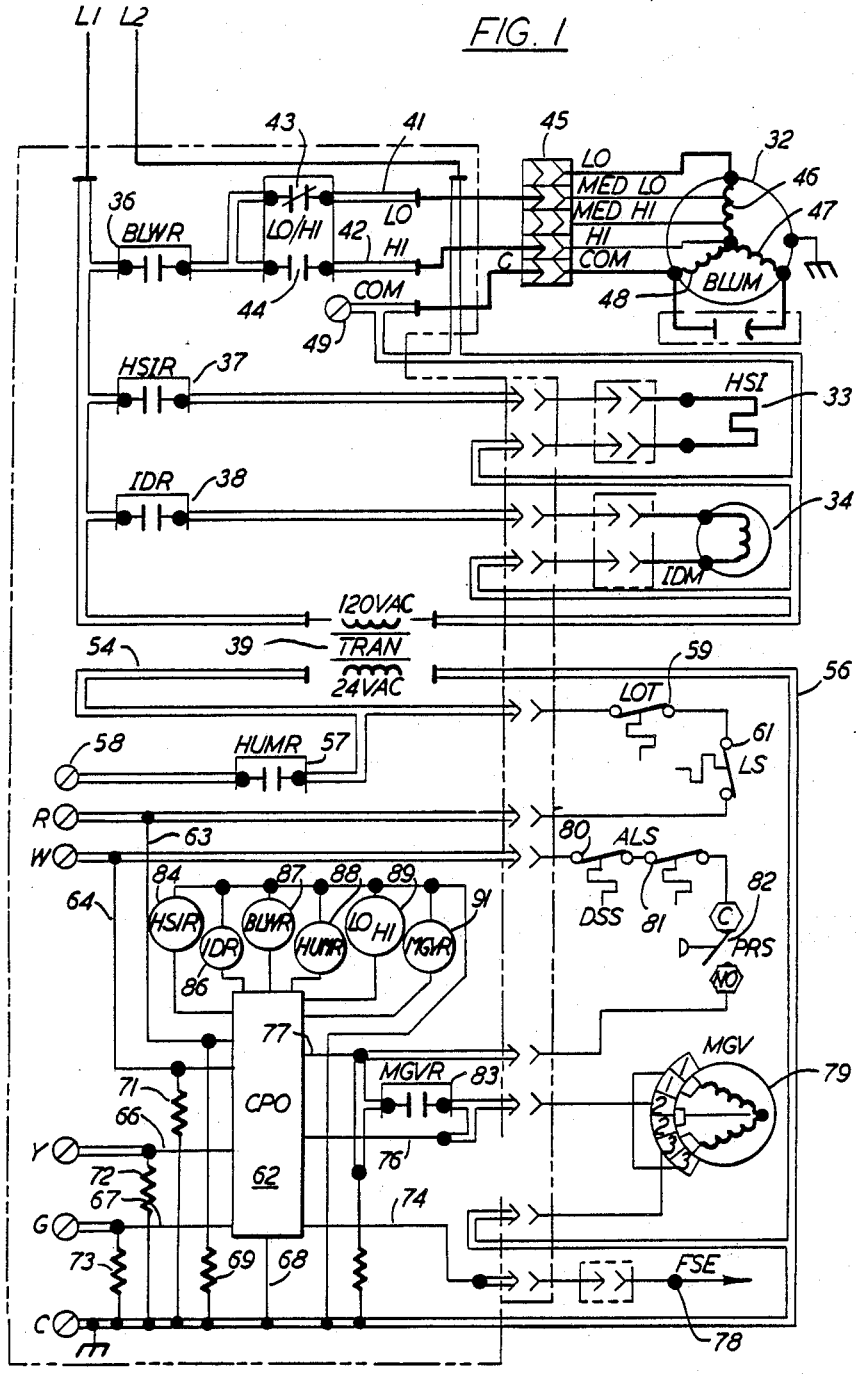
FIG. 1 is a schematic illustration of a furnace control system having the present invention incorporated therein.

Referring now to FIG. 1, the various components of an induced draft gas furnace are shown together with their controlling circuitry which is adapted to operate in accordance with the present invention. A circuit board 31, indicated by the broken lines, is provided with line voltage by way of leads L1 and L2. Power is thereby provided to a circulating air blower motor 32, a hot surface igniter 33, and an induced draft blower motor 34 by way of relays 36, 37 and 38, respectively. Power is also provided to the control portion of the circuit board by way of a low voltage stepdown transformer 39.

Included in the circuit supplying power to the blower motor 32, in addition to the relay 36, are parallel leads 41 and 42 which provide for low and high speed connections, respectively, and a single pole, double throw relay with the low speed lead 41 having normally closed relay contacts 43 and the high speed lead 42 having normally open relay contacts 44. Both the low speed lead 41 and the high speed lead 42 are connected by way of a five circuit connector 45 to one leg 46 of the Wye connected blower motor 32, with the other legs 47 and 48 being connected via the connector 45 to a common terminal 49. Thus, by selectively choosing the desired connector 45 terminals to be used, and by controlling the relay contacts 43 and 44, the blower motor 32 can be selectively caused to operate at either of the selected levels of low or high speeds.

Referring now to the control or bottom portion of the circuit, low voltage power is provided from the secondary coil of the transformer 39 to the conductor 54 and to the conductor 56, which is connected to the common terminal C. The conductor 54 is electrically connected through normally open relay contacts 57 to a terminal 58 which can be connected to provide power to auxiliary equipment such as a humidifier (not shown), and also to a circuit which includes a manually resettable limit switch 59 sensitive to overtemperature, an automatic resettable limit switch 61 sensitive to overtemperature, and the terminal R.

In addition to the conventional connections as discussed hereinabove, the R, W, Y, G, and C terminals of the circuit board 31 are connected in a conventional manner to the room thermostat (not shown). However, unlike the conventional circuit without microprocessor control, each of those terminals is connected to a microprocessor 62 by way of leads 63, 64, 66, 67, and 68, respectively. Load resistors 69, 71, 72 and 73 are provided between the common terminal C and the respective terminals R, W, Y and G to increase the current flow through the circuits to thereby prevent the occurrence of dry contacts.

Other inputs to the microprocessor 62 are provided along lines 74, 76 and 77. The line 74 is connected to a flame sensing electrode 78 to provide a signal to the microprocessor to indicate when a flame has been proven to exist. Lines 76 and 77 provide other indications as will be discussed hereinafter. Power to the main gas valve 79 is received from the terminal W by way of a draft safeguard switch 80, an auxiliary limit switch 81, a pressure switch 82 and the normally open relay 83. The microprocessor 62 is made aware of the condition of the auxiliary limit switch 81 and the pressure switch 82 by way of signals received along line 77. The line 76 is connected to the output of the relay 83 and provides voltage level signals to indicate to the microprocessor 62, whether the gas valve should be on or off.

Having described the circuits that are controlled by the microprocessor 62 through the use of relays, the controlling outputs of the microprocessor 62 will now be briefly described. The hot surface ignitor output 84 operates to close the relay contacts 37 to activate the hot surface igniter 33. The inducer motor output 86 operates to close the relay contacts 38 to activate the inducer motor 34. The blower motor output 87 operates to close the relay contacts 36 to activate the blower motor 32. The humidifier output 88 operates to close the relay contacts 57 to activate the humidifier. The low/high relay output 89 operates to open the relay contacts 43 and close the relay contacts 44 to switch the blower motor 32 from low to high speed operation. Finally, the main gas valve output 91 operates to close the relay contacts 83 to open the main gas valve 79.

Considering now the operation of the control apparatus during a typical heating cycle, the sequence of operation will be as follows. When the wall thermostat calls for heat, the R and W circuits are closed. The microprocessor 62 checks the inputs and outputs and energizes the inducer relay 38 to start the inducer motor 34 and initiate the process of purging the system of unwanted gas. As the inducer motor 34 comes up to speed, the pressure switch 82 closes, and after a predetermined period of time, the microprocessor 62 activates the hot surface ignitor relay 37 to provide power to the hot surface ignitor 33. After a warm-up period of a predetermined time, the microprocessor 62 activates the main gas valve relay 83 to provide power to and turn on the main gas valve 79. As soon as a flame is sensed by the flame sensing electrode 78, the microprocessor 62 deactivates the hot surface ignitor 37, and holds the main gas valve on so long as the flame is present or until the thermostat is satisfied. When the thermostat is satisfied, the R and W circuits are de-energized to thereby de-energize the main gas valve 79, and, after a post-purge period, the inducer motor 74.

Assume now that the system is operating in the continuous blower mode of operation. If there is neither a call for heat nor a call for cooling, then the blower should remain on at a low speed. If there is a call for cooling, the blower will come on at the higher operating speed for the duration of the cooling period, and then it will automatically reduce to the lower speed of operation. If there is a call for heat during the time when the blower is in the continuous mode of operation, then the present invention will function to prevent the simultaneous operation of the blower motor and the ignitor as will be seen in FIG. 2.

Figure 2A:
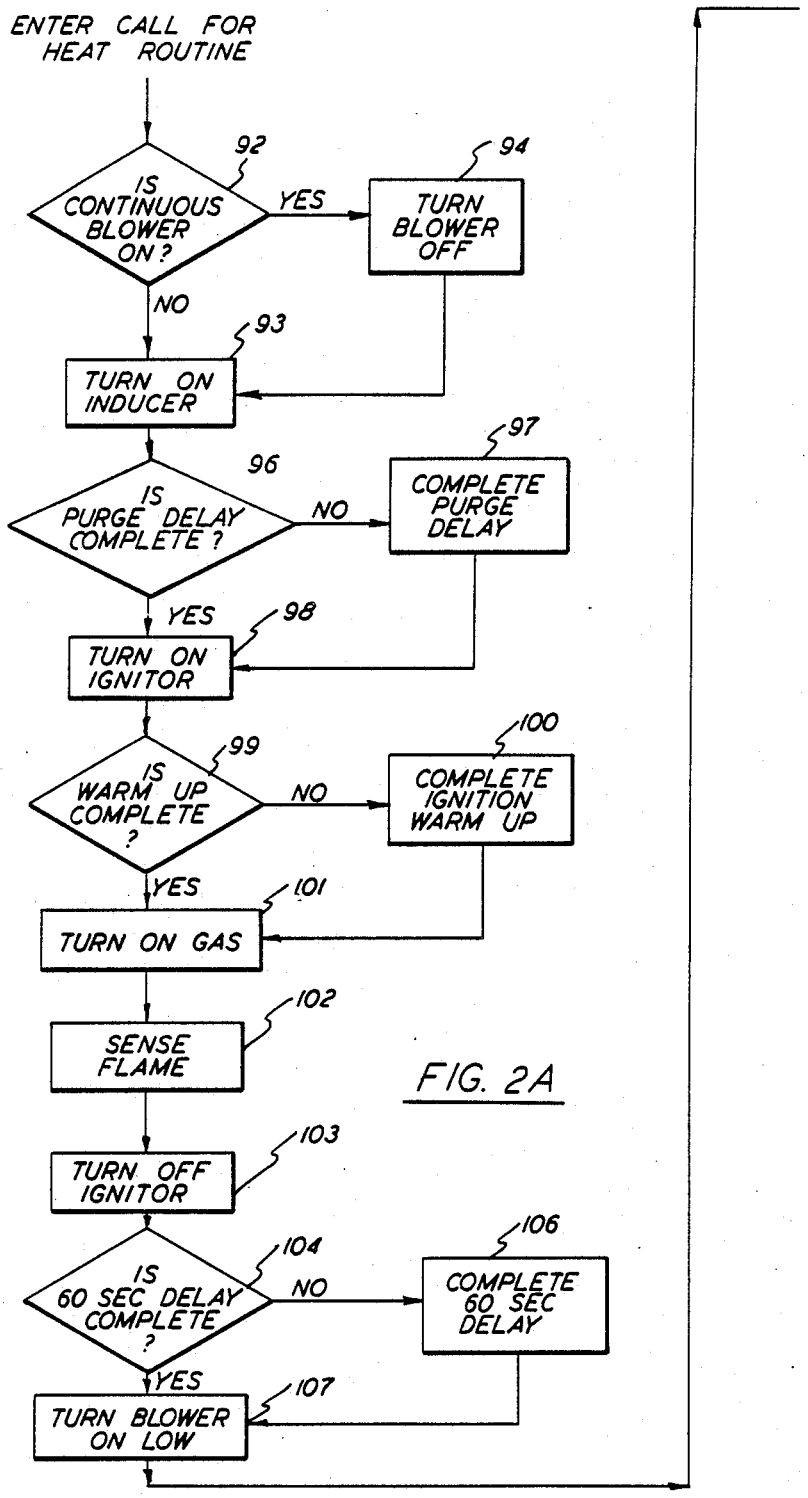
FIG. 2 is a flow diagram showing the operation of the present invention.
Figure 2B:
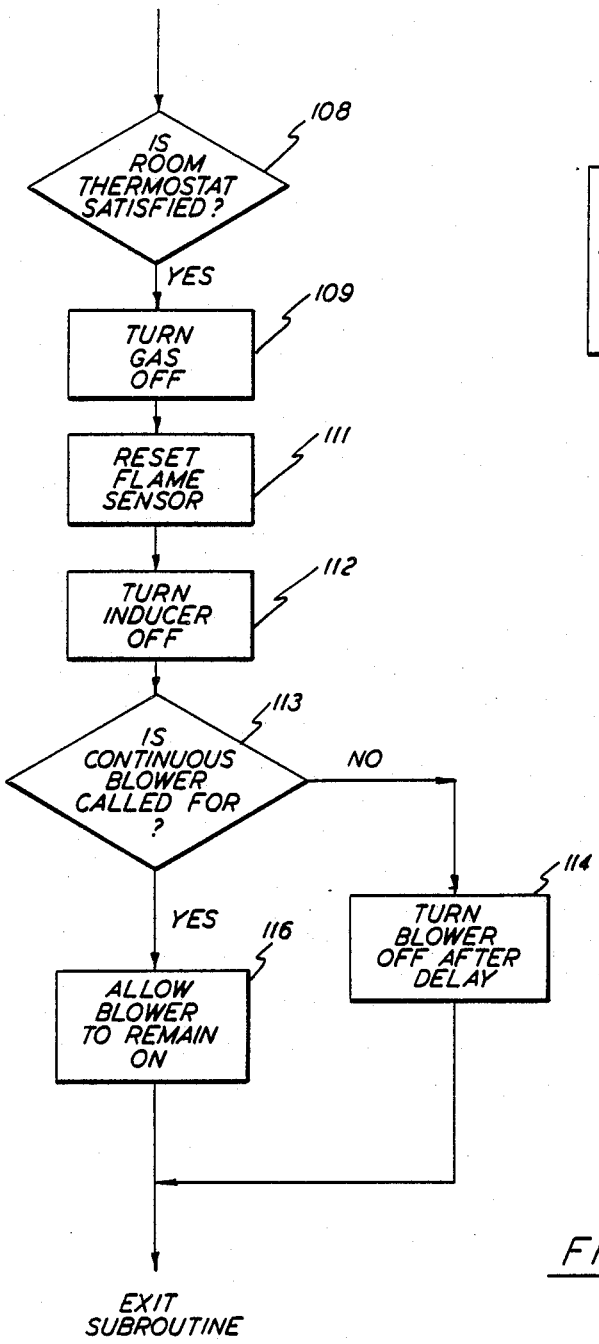
Figure 2:
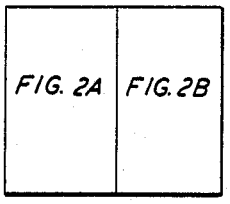

When a call for heat is initiated by the thermostat, the microprocessor enters the routine of FIG. 2 and proceeds to determine, in accordance with block 92, whether the system is operating in a continuous blower-on condition. If not, the inducer is turned on to commence the purging operation as shown in block 93. If the system is determined to be operating in a continuous blower-on condition, the system steps to block 94 where the microprocessor then operates to turn off the blower 32 by opening the relay contacts 36, after which the inducer is turned on. After the purging is complete, as determined by a predetermined time period in accordance with blocks 96 and 97, the ignitor is turned on as indicated in block 98. The ignitor is then given a sufficient time to warm up as provided in blocks 99 and 100, and then the gas is turned on as shown in block 101. After a flame is sensed in block 102, the ignitor is turned off as shown in block 103.

Besides turning the blower off for the purpose mentioned hereinabove (i.e. so that the blower is not turned on when the ignitor comes on), the blower is also turned off for the purpose of allowing the heat exchanger to warm up prior to the blower coming on and causing condensation in the relatively cool heat exchangers. For this reason, the turning on of the blower is delayed for a period of 60 seconds, as indicated by blocks 104 and 106, and then the microprocessor 62 activates the blower relay 36 to turn on the blower motor 32 at a lower speed as shown in block 107.

As the temperature in the room increases, the thermostat will finally be satisfied as indicated in block 108 at which time the gas will be turned off, the flame sensor will be reset and the inducer will be turned off as indicated in blocks 109, 111, and 112 respectively. The microprocessor 62 then queries whether the continuous blower operation is called for, a indicated in block 113. If not, the system will step to block 114 where, after a suitable delay, the blower will be turned off, and then the system will exist the subroutine. If continuous blower operation is called for, the system will step to block 116 which allows the blower to remain on at a low speed, and the main routine is resumed.

While the present invention has been disclosed with particular reference to a preferred embodiment, concepts of this invention are readily adaptable to other embodiments, and those skilled in the art may vary the structure and method thereof without departing from the essential spirit of the present invention.

What is claimed is:

1. In a residential furnace of the type which is responsive to a thermostat and has an electronic ignitor, and a circulating air blower that may be operated on a continuous basis, an improved process of controlling said thermostat, electrical ignitor and blower in an ignition sequence of said furnace comprising the steps of:

upon receiving a call for heat from a thermostat, checking to determine if the circulating air blower is on;

if the blower is on, turning it off; and only after the blower is turned off, turning on the ignitor to initiate the combustion process.

2. The process as set forth in claim 1 wherein said furnace includes a draft inducer and wherein the process includes the additional step of turning on the inducer prior to turning on the ignitor.

3. The process as set forth in claim 1 wherein said furnace includes a flame sensor, and wherein the process includes a step of sensing the existence of a flame and, if a flame exists, turning off the ignitor.

4. The process as set forth in claim 3 and including the additional step of waiting a predetermined time after turning off the ignitor and then turning on the circulating air blower.

5. The process as set forth in claim 2 and including the step of allowing the blower to continue to operate in the continuous mode of operation when the draft inducer is turned off at the end of a heating cycle.

6. In a gas furnace of the type having a control system for controlling an electronic ignitor for selectively initiating ignition of fuel supplied to a burner and a blower for circulating the heated air to a space to be heated, wherein the simultaneous operation of the ignitor and blower will draw sufficient current so as to burn out a fuse, the improvement comprising:

sensing means for determining when the blower is on prior to turning on said ignitor; indicating means responsive to said sensing means for indicating the condition of the blower; and inhibition means responsive to said indicating means for inhibiting the turning on of the ignitor if said indicating means indicates that the blower is on.

7. A control system as set forth in claim 6 and including an activation means responsive to said indicating means for turning off the blower prior to the ignitor being turned on in the process of a heating cycle.

8. In a residential furnace of the type having a burner for receiving gas and combustion air, an electronic ignitor for selectively initiating combustion at the burner, and a circulating air blower for moving heated air to a space to be heated, wherein the blower is selectively capable of operating on a continuous basis, an improved control method comprising the steps of:

turning on the inducer to purge the system of any unwanted gases;

turning on the fuel flow to the burner;

sensing whether the blower is on;

if it is on, turning it off prior to ignition; and only after the blower has been turned off, turning on the ignitor to initiate combustion.

9. A control method as set forth in claim 8 wherein said furnace includes a flame sensor and wherein the process includes the additional step of sensing the existence of a flame and turning off the electronic ignitor when a flame is sensed.

10. A method as set forth in claim 9 and including the additional steps of providing a delay after a flame is sensed and then turning the circulating air blower on.

11. A method as set forth in claim 10 and including the additional steps of turning the inducer off at the end of a heating cycle and allowing the blower to continue to operate on a continuous basis.

* * * * *